US008313043B1

(12) United States Patent
Crooks et al.

(10) Patent No.: US 8,313,043 B1
(45) Date of Patent: Nov. 20, 2012

(54) FRICTION CLUTCH FOR ROTOR-TYPE SPRINKLER

(75) Inventors: John D. Crooks, San Diego, CA (US); Fred M. Danner, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 1228 days.

(21) Appl. No.: 11/625,206

(22) Filed: Jan. 19, 2007
(Under 37 CFR 1.47)

(51) Int. Cl.
*B05B 3/00* (2006.01)
*B05B 15/10* (2006.01)
*B05B 3/16* (2006.01)

(52) U.S. Cl. ..... 239/206; 239/205; 239/242; 239/263; 239/263.3

(58) Field of Classification Search ..... 239/206, 239/200, 201, 203, 205, 240, 242, 263, 263.3, 239/256; 192/56.1; 464/30, 33, 39, 40, 44; 403/147
See application file for complete search history.

(56) References Cited

U.S. PATENT DOCUMENTS 3,107,056 A 10/1963 Hunter
3,111,822 A * 11/1963 Hansen ..... 464/40
3,149,784 A * 9/1964 Skidgel ..... 239/206
3,334,817 A * 8/1967 Miller et. al. ..... 239/113
RE27,114 E * 4/1971 Scheublein, Jr. ..... 403/147
3,637,138 A * 1/1972 Rucker ..... 239/227
3,659,798 A * 5/1972 Mindler et al. ..... 396/411
3,700,838 A * 10/1972 Brown et al. ..... 200/38 R
3,878,990 A * 4/1975 Geraudie ..... 239/236
3,921,912 A * 11/1975 Hayes ..... 239/242
3,934,820 A 1/1976 Phaup ..... 239/205
4,305,326 A * 12/1981 Sallach et al. ..... 89/33.25
4,417,691 A * 11/1983 Lockwood ..... 239/206
4,464,137 A * 8/1984 Jennings ..... 464/48
4,568,024 A 2/1986 Hunter ..... 239/242
4,625,914 A 12/1986 Secton et al. ..... 239/206
4,718,605 A * 1/1988 Hunter ..... 239/242
4,765,770 A * 8/1988 Buhl ..... 403/146
4,892,252 A * 1/1990 Bruninga ..... 239/205
4,901,924 A * 2/1990 Kah, Jr. ..... 239/242
5,048,757 A 9/1991 Van Leeuwen ..... 239/205
5,148,991 A 9/1992 Kah, Jr. ..... 239/242
5,170,871 A * 12/1992 Batchelder ..... 192/41 S
5,383,600 A 1/1995 Verbera et al. ..... 239/205
5,673,855 A * 10/1997 Nguyen et al. ..... 239/241
5,676,315 A * 10/1997 Han ..... 239/590
5,695,123 A * 12/1997 Le ..... 239/259
5,758,827 A * 6/1998 Van Le et al. ..... 239/242
5,785,248 A * 7/1998 Staylor et al. ..... 239/237
6,042,021 A 3/2000 Clark ..... 239/205
6,050,502 A 4/2000 Clark ..... 239/237
6,732,950 B2 * 5/2004 Ingham et al. ..... 239/205
6,840,460 B2 1/2005 Clark ..... 239/205
6,866,588 B2 * 3/2005 Doornbos ..... 464/40
6,869,026 B2 * 3/2005 McKenzie et al. ..... 239/237
(Continued)

*Primary Examiner* — Len Tran
*Assistant Examiner* — Steven M Cernoch
(74) *Attorney, Agent, or Firm* — Michael H. Jester

(57) ABSTRACT

A sprinkler includes a riser, an impeller mounted in the riser, and a nozzle rotatably mounted at an upper end of the riser. A drive assembly including a reduction gear train couples the impeller and the nozzle. A friction clutch is located in the drive assembly between an output gear of the reduction gear train and an input gear of the reversing mechanism and provides a positive drive connection under a normal load and slips under an excessive load. An alternate embodiment utilizes the friction clutch in a rotor-type sprinkler in which the nozzle rotates continuously through a continuous 360 degree arc.

10 Claims, 13 Drawing Sheets

U.S. PATENT DOCUMENTS 6,921,030 B2 * 7/2005 Renquist ..... 239/380
6,945,471 B2 * 9/2005 McKenzie et al. ..... 239/237
7,017,831 B2 * 3/2006 Santiago et al. ..... 239/222.13
7,040,553 B2 * 5/2006 Clark ..... 239/263.3
7,090,146 B1 * 8/2006 Ericksen et al. ..... 239/200
7,156,322 B1 * 1/2007 Heitzman ..... 239/240
7,318,776 B2 * 1/2008 Honda ..... 464/40
7,530,504 B1 * 5/2009 Danner et al. ..... 239/240
7,712,592 B2 * 5/2010 Jansen et al. ..... 192/41 S
2004/0050958 A1 * 3/2004 McKenzie et al. ..... 239/242
2004/0077410 A1 * 4/2004 Gibbons et al. ..... 464/40
2005/0194465 A1 * 9/2005 Wang ..... 239/263
2005/0261064 A1 * 11/2005 Honda ..... 464/40
2006/0049275 A1 * 3/2006 Santiago et al. ..... 239/240
2006/0108446 A1 * 5/2006 Yeh et al. ..... 239/240
2006/0273193 A1 * 12/2006 Kah ..... 239/206
2008/0194339 A1 * 8/2008 Antchak et al. ..... 464/40

* cited by examiner

FRICTION CLUTCH FOR ROTOR-TYPE SPRINKLER

FIELD OF THE INVENTION

The present invention relates to sprinklers used to irrigate turf and landscaping, and more particularly, to clutch mechanisms designed to prevent drive assembly damage when vandals twist the nozzle turret of a rotor-type sprinkler.

BACKGROUND OF THE INVENTION

A common type of irrigation sprinkler used to water turf and landscaping is referred to as a rotor-type sprinkler. It typically includes a riser that telescopes from an outer casing. The riser encloses a turbine that rotates a nozzle turret at the top of the riser through a reduction gear train and reversing mechanism. Typically the nozzle turret oscillates back and forth through an arc whose size can be adjusted depending on the area of coverage required. Vandals frequently twist the nozzle turret of rotor-type sprinklers which causes them to spray water outside their intended arc of coverage, often onto roads and sidewalks. When a vandal twists the nozzle turret of a rotor-type sprinkler to "back drive" the sprinkler, i.e. rotate the nozzle turret in a direction opposite the direction it is currently being driven by its turbine, strong rotational forces are transmitted to the reversing mechanism and reduction gear train, frequently damaging the same.

Rotor-type sprinklers have included some form of clutch that slips when the nozzle turret is rotated by an external force, i.e. one not generated by the turbine. A clutch in a rotor-type sprinkler must be able to transmit a steady rotational drive force to the nozzle turret so that the turbine can rotate the nozzle turret back and forth between the pre-set arc limits, or in some cases, rotate the nozzle turret continuously through three hundred and sixty degrees. However the clutch must be capable of breaking loose or disengaging when the nozzle turret is twisted by a vandal.

Rotor-type sprinklers have also been developed that include an automatic arc return mechanism so that the nozzle turret can be twisted out of arc by a vandal, and will resume oscillation within the intended arc of coverage without any resulting damage to the reduction gear train or reversing mechanism. See for example U.S. Pat. No. 6,050,502 granted to Clark on Apr. 18, 2000 and U.S. Pat. No. 6,840,460 granted to Clark on Jan. 11, 2005, both assigned to Hunter Industries, Inc., the assignee of the subject application.

Clutches and automatic arc return mechanisms that have heretofore been developed for rotor-type sprinklers have been too complex, required too many parts and/or been too unreliable. They have also not been suitable for retrofitting, i.e. installation into existing rotor-type sprinklers not originally designed with clutches to prevent back driving.

SUMMARY OF THE INVENTION

In accordance with the invention, a sprinkler includes a riser, an impeller mounted in the riser, and a nozzle rotatably mounted at an upper end of the riser. A drive assembly including a reduction gear train couples the impeller and the nozzle. A friction clutch in the drive assembly is coupled with an output gear of the reduction gear train and provides a positive drive connection under a normal load and slips under an excessive load.

DETAILED DESCRIPTION

The entire disclosures of U.S. Pat. No. 3,107,056 granted to Hunter on Oct. 15, 1963; U.S. Pat. No. 4,568,024 granted to Hunter on Feb. 4, 1986; U.S. Pat. No. 4,718,605 granted to Hunter on Jan. 12, 1988; U.S. Pat. No. 6,050,502 granted to Clark on Apr. 18, 2000; U.S. Pat. No. 6,840,460 granted to Clark on Jan. 11, 2005; pending U.S. patent application Ser. No. 11/139,725 filed by John D. Crooks on May 27, 2005, and pending U.S. patent application Ser. No. 11/612,801 filed by John D. Crooks on Dec. 13, 2006, are hereby incorporated by reference.

Figure 1:
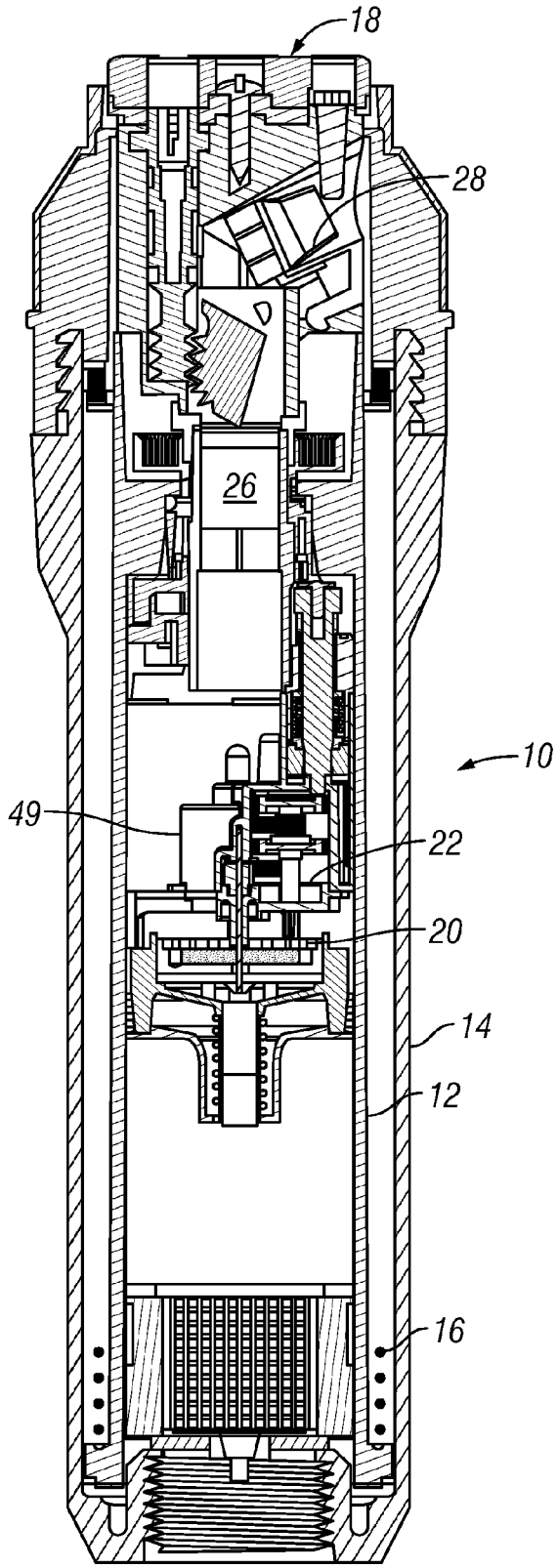
FIG. 1 is a vertical sectional view of a rotor-type sprinkler in accordance with an embodiment of the invention.

Referring to FIG. 1, in accordance with an embodiment of the invention, a rotor-type sprinkler 10 includes a tubular riser 12 vertically reciprocable within an outer case 14 and normally held in a retracted position by a relatively large stainless steel coil spring illustrated diagrammatically by dots 16. A cylindrical nozzle head or turret 18 is rotatably mounted at the upper end of the riser 12. A turbine 20, reduction gear train 22, and a reversing mechanism 24 (FIGS. 2-5) are mounted in the riser 12 and rotate the nozzle turret 18 through an adjustable arc, as well known in the art. Besides the turbine 20, other impellers may be used, such as ball drives, swirl plates, and so forth. See for example U.S. Pat. No. 4,625,914 granted to Sexton et al. on Dec. 2, 1986.

The reversing mechanism 24 operates in conjunction with a resilient shift dog (not illustrated), arc adjustment tabs (not illustrated), and a top-side accessible arc adjustment mechanism (not illustrated), details of which are disclosed in pending U.S. patent application Ser. No. 11/139,725, of John D. Crooks, filed May 27, 2005, incorporated by reference above. Thus the sprinkler 10 can operate as an arc adjustable oscillating rotor-type sprinkler with automatic arc return. The automatic arc return feature is desirable because if a vandal spins the nozzle turret 18 outside its pre-set arc limits, the sprinkler 10 will quickly return to normal oscillating motion so that the stream of water ejected from the nozzle 28 stays within the pre-set arc limits. The sprinkler 10 can also be adjusted so that its two arc adjustment tabs overlap, in which case the sprinkler 10 operates in a full circle mode (360 degrees of continuous rotation).

The reduction gear train 22 and reversing mechanism 24 form part of a drive assembly coupling the turbine 20 and the nozzle turret 18 via a relatively large hollow tubular shaft 26 (FIG. 1). Water flows through the turbine 20, through the shaft 26 and exits through a replaceable nozzle 28 mounted in the nozzle turret 18. The nozzle 28 of the illustrated embodiment is removably mounted in snap-in fashion in a socket in the nozzle turret 18. See U.S. Pat. No. 6,871,795 granted to Anuskiewicz on Mar. 29, 2005, the entire disclosure of which is hereby incorporated by reference. Alternatively, the nozzle 28 can be a permanent fixture not requiring any turret for support. In such a case the drive assembly still couples the turbine 20 and the nozzle 28. In the embodiment illustrated, the drive assembly couples the turbine 20 and the nozzle 28 though the shaft 26 and the nozzle turret 18. A friction clutch 30 (FIG. 4), described hereafter in detail, is also included in the drive assembly between a final output gear 32 (FIG. 1) of the reduction gear train 22 and an input gear 34 (FIGS. 2 and 3) of the reversing mechanism 24. The friction clutch 30 provides a positive drive connection under a normal load and slips under an excessive externally applied load such as that which occurs when a vandal twists the nozzle turret 18.

Figure 2:
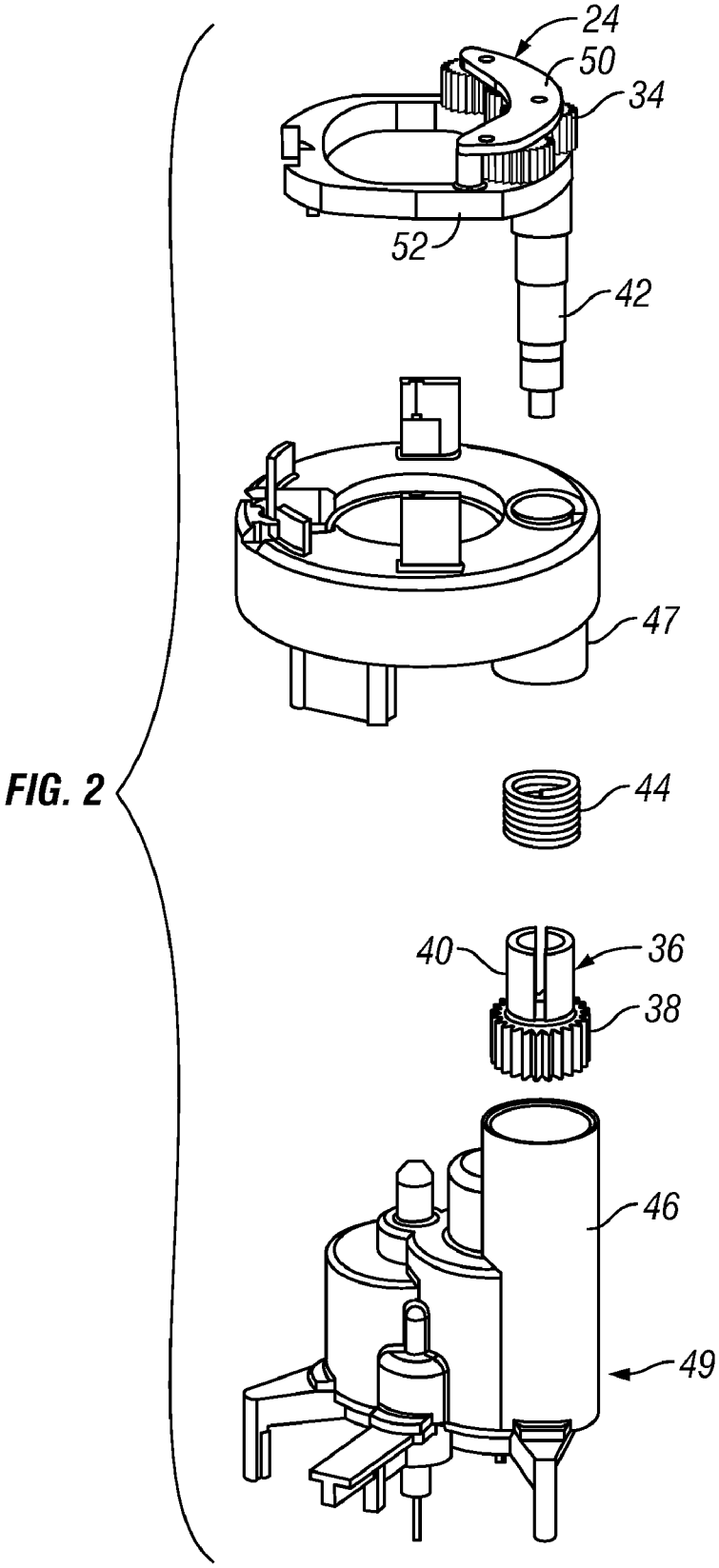
FIG. 2 is an enlarged exploded isometric view of the reversing mechanism, partition, friction clutch and gear box of the sprinkler of FIG. 1.
Figure 3:
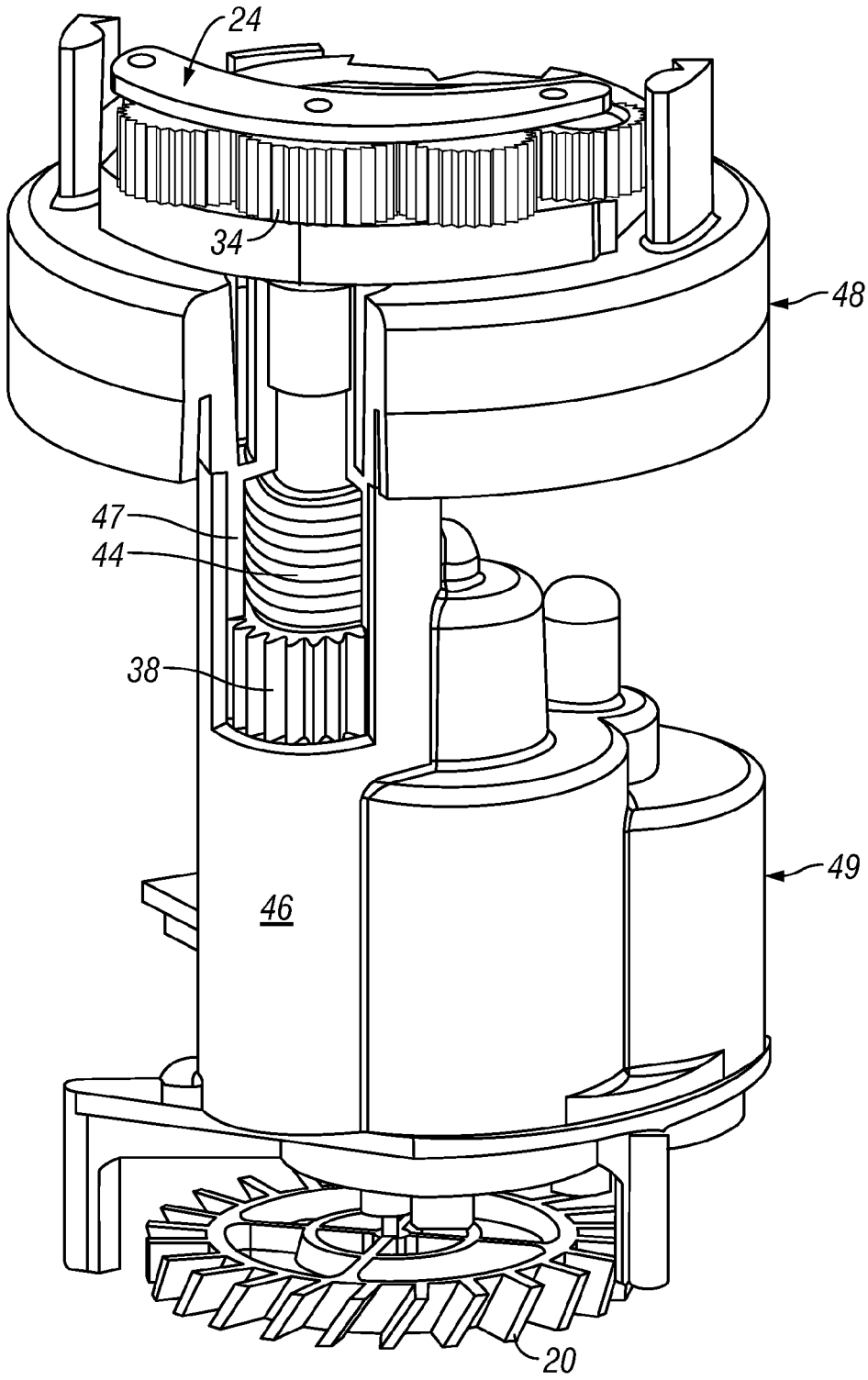
FIG. 3 is an isometric view of the assembled components illustrated in FIG. 2 and also showing a portion of the gear box cut away to indicate the location of the friction clutch.
Figure 4:
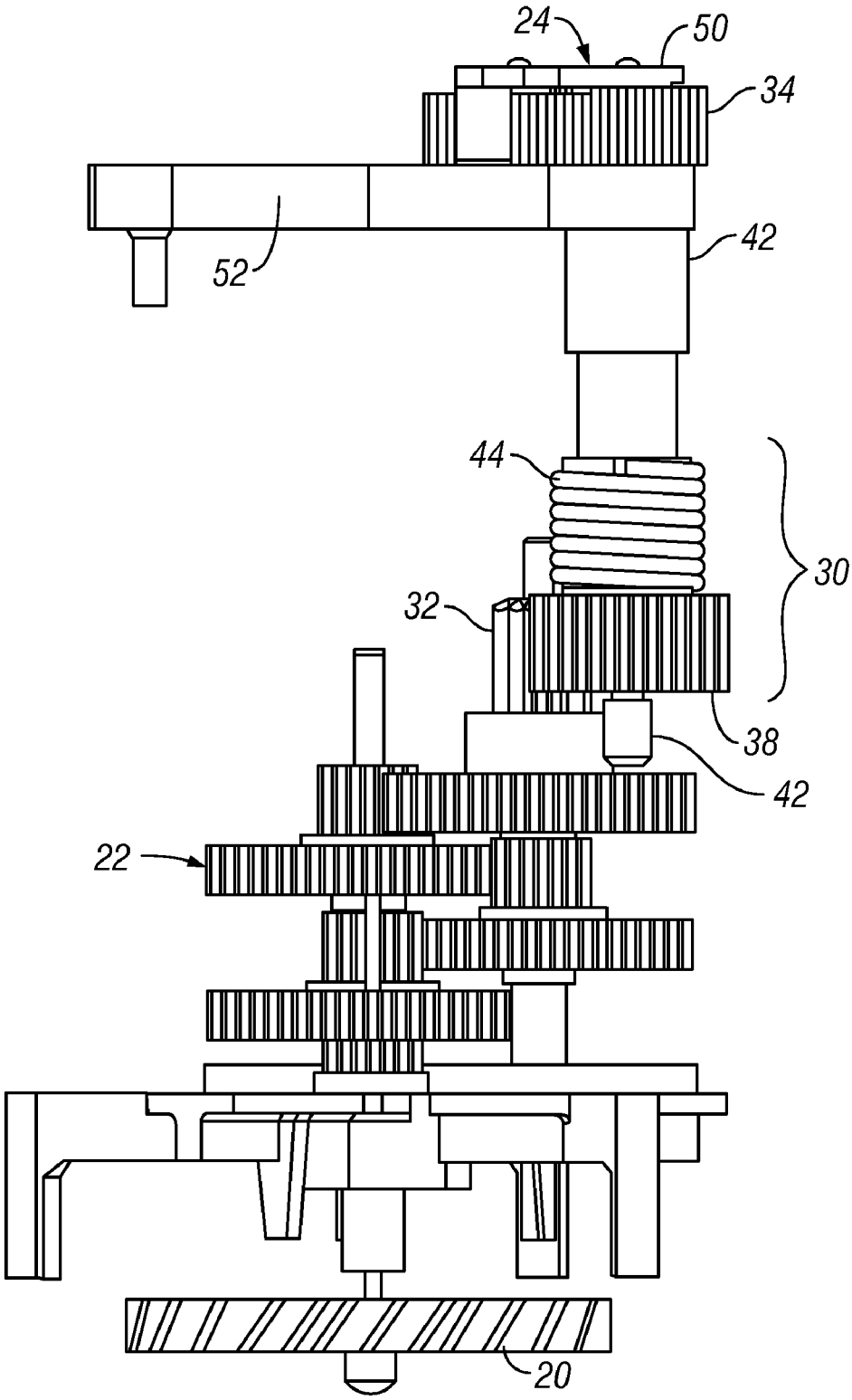
FIG. 4 is an enlarged side elevation view with portions cut away illustrating further details of the gear train reduction, friction clutch and reversing mechanism of the sprinkler of FIG. 1.
Figure 5:
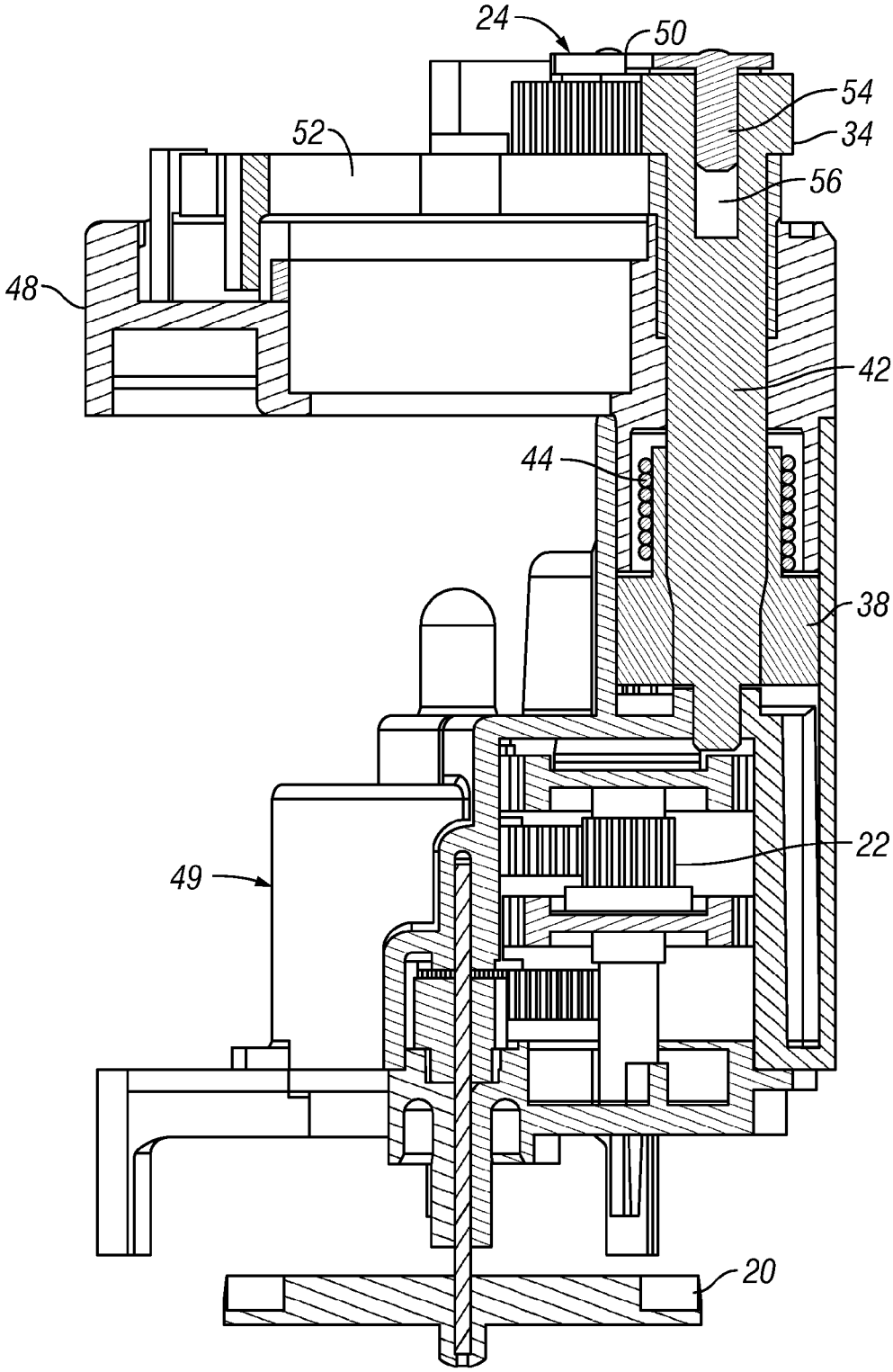
FIG. 5 is a vertical sectional view of the assembled components illustrated in FIG. 3.
Figure 6:
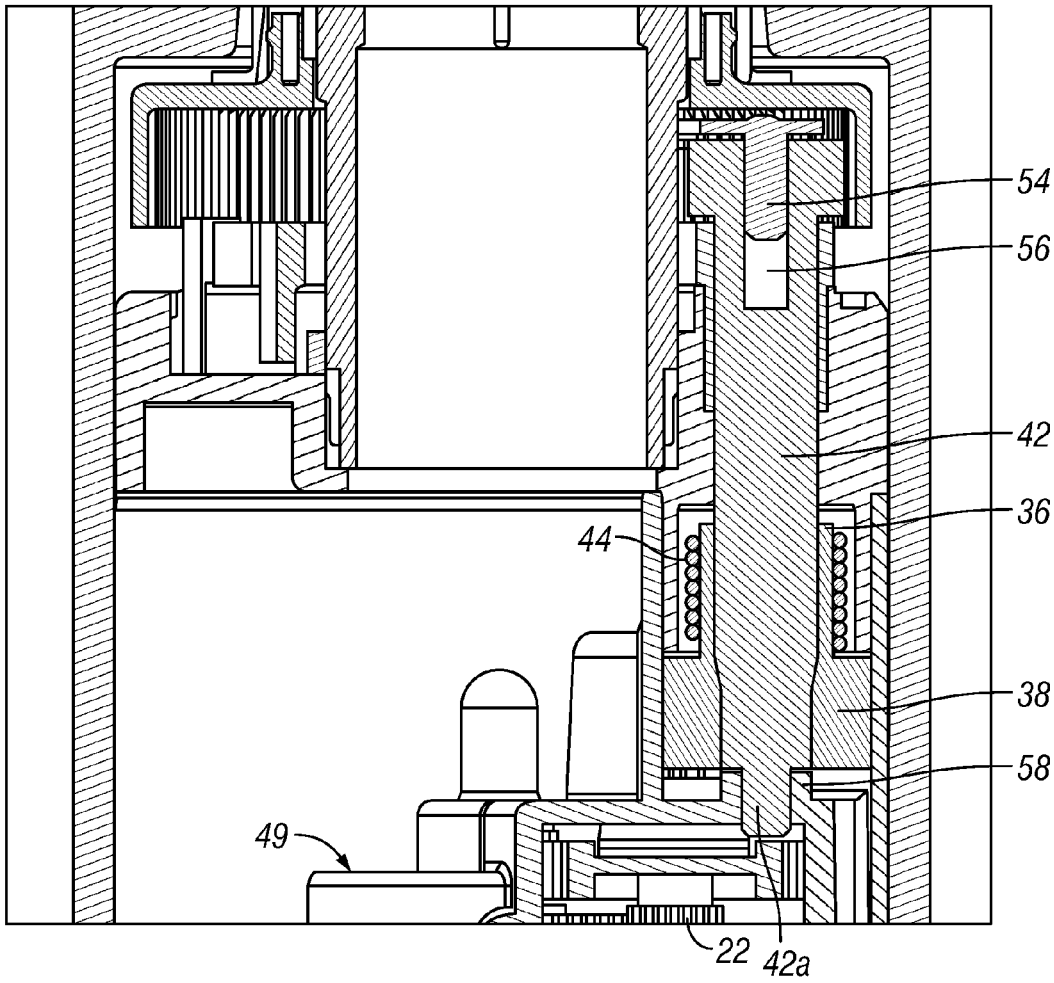
FIG. 6 is a still further enlarged cross-sectional view illustrating the relationship of the friction clutch to its surrounding components.
Figure 7:
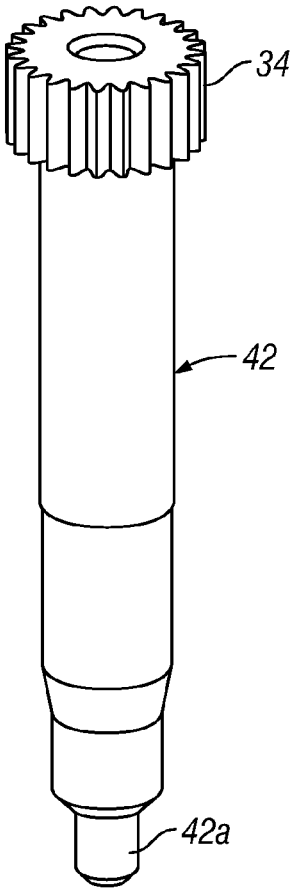
FIG. 7 is an enlarged isometric view of the output shaft of the friction clutch.
Figure 8A:
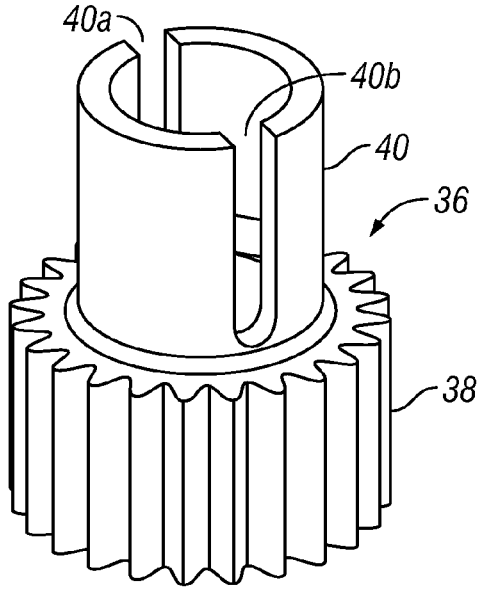
FIGS. 8A and 8B are isometric views of the clutch member of the friction clutch taken from above and below, respectively.
Figure 8B:
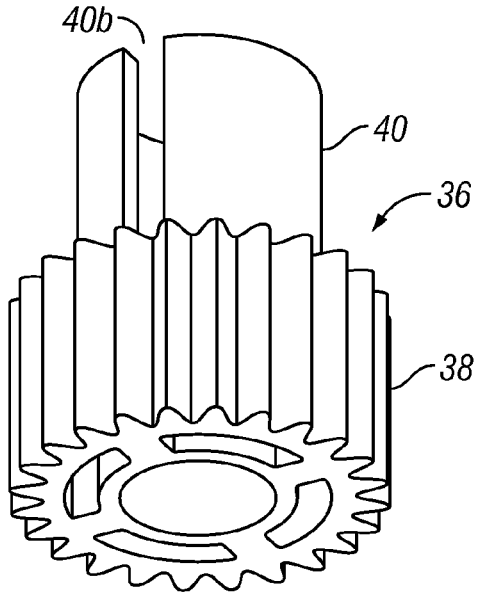
Figure 9:
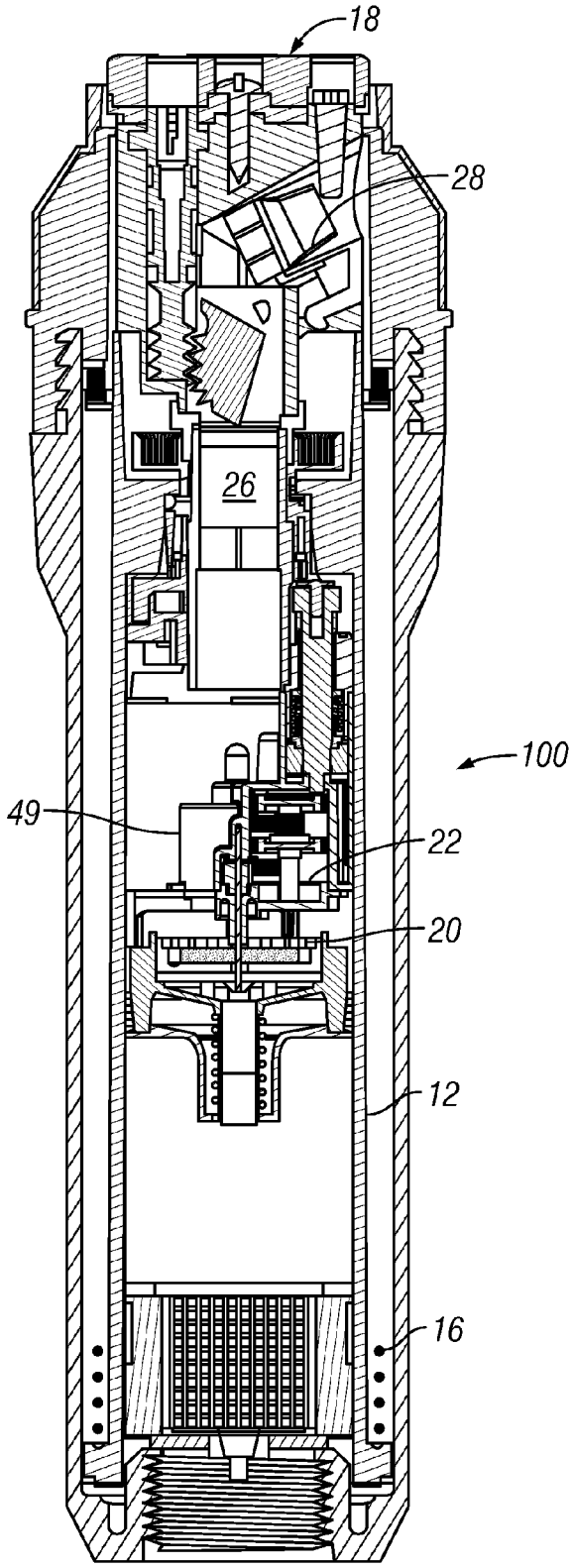
FIGS. 9-14 are views corresponding to FIGS. 1-6 illustrating details of a rotor-type sprinkler in accordance with an alternate embodiment of the invention that can only rotate the nozzle continuously, i.e. the nozzle cannot be made to oscillate back and forth between arc limits.
Figure 10:
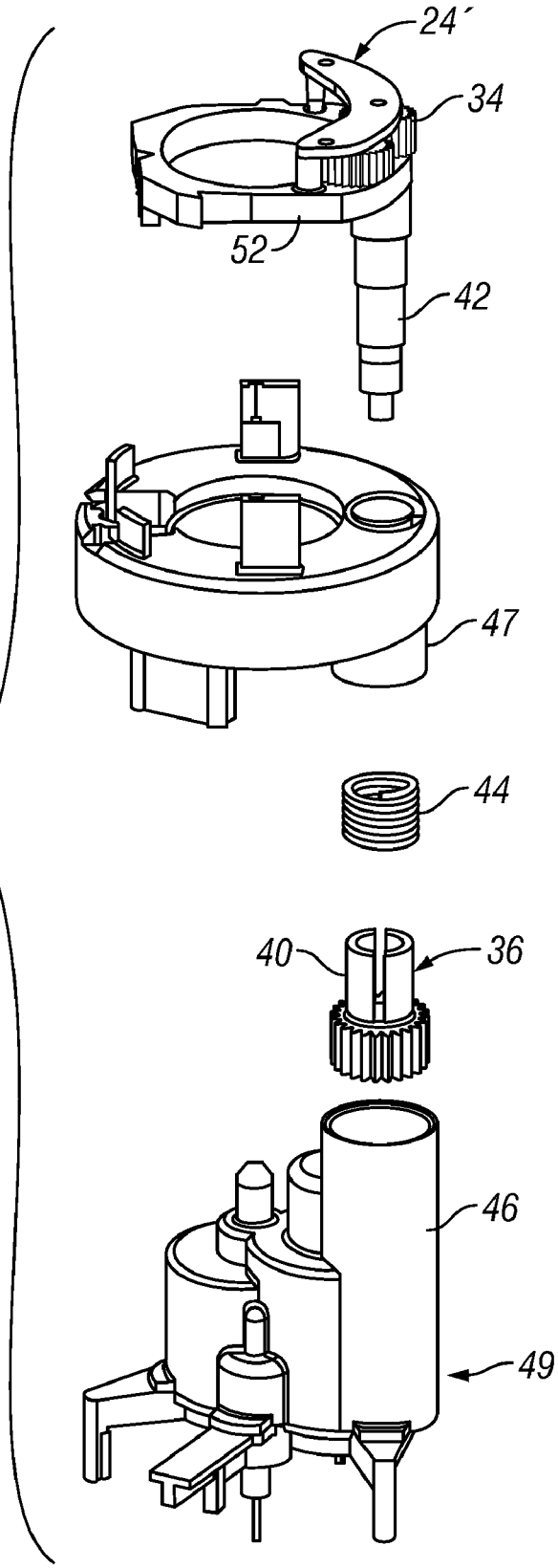
Figure 11:
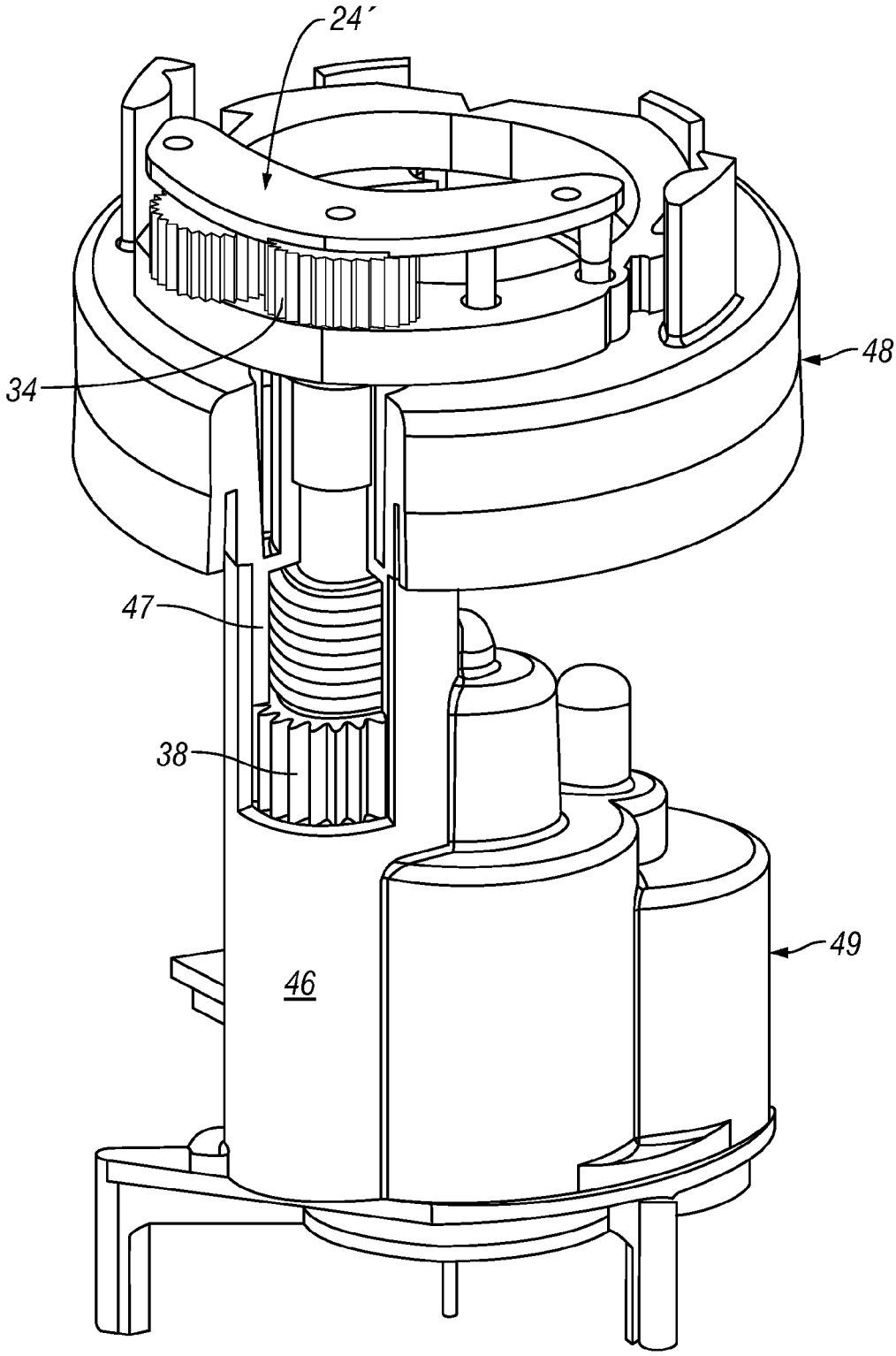
Figure 12:
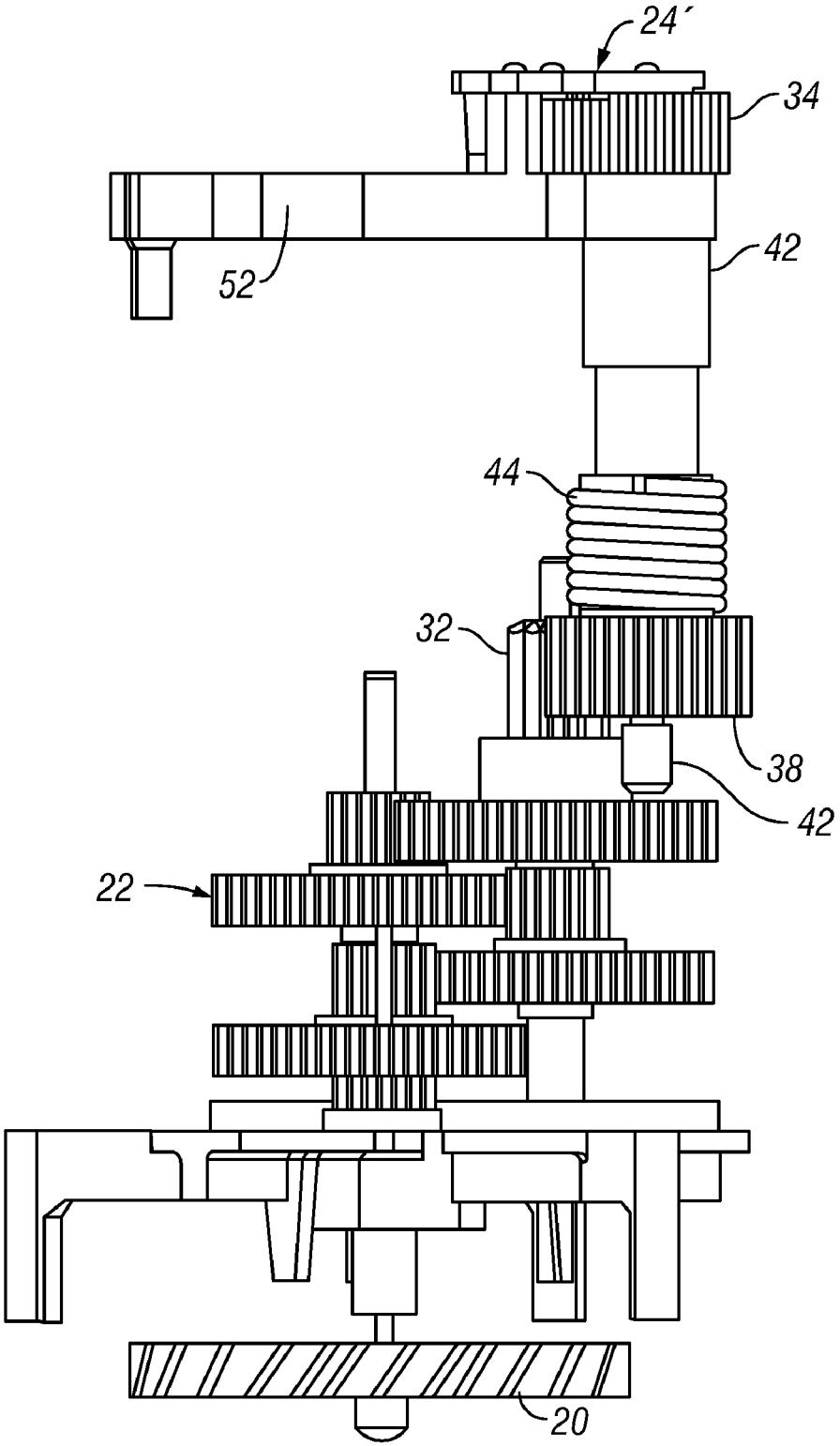
Figure 13:
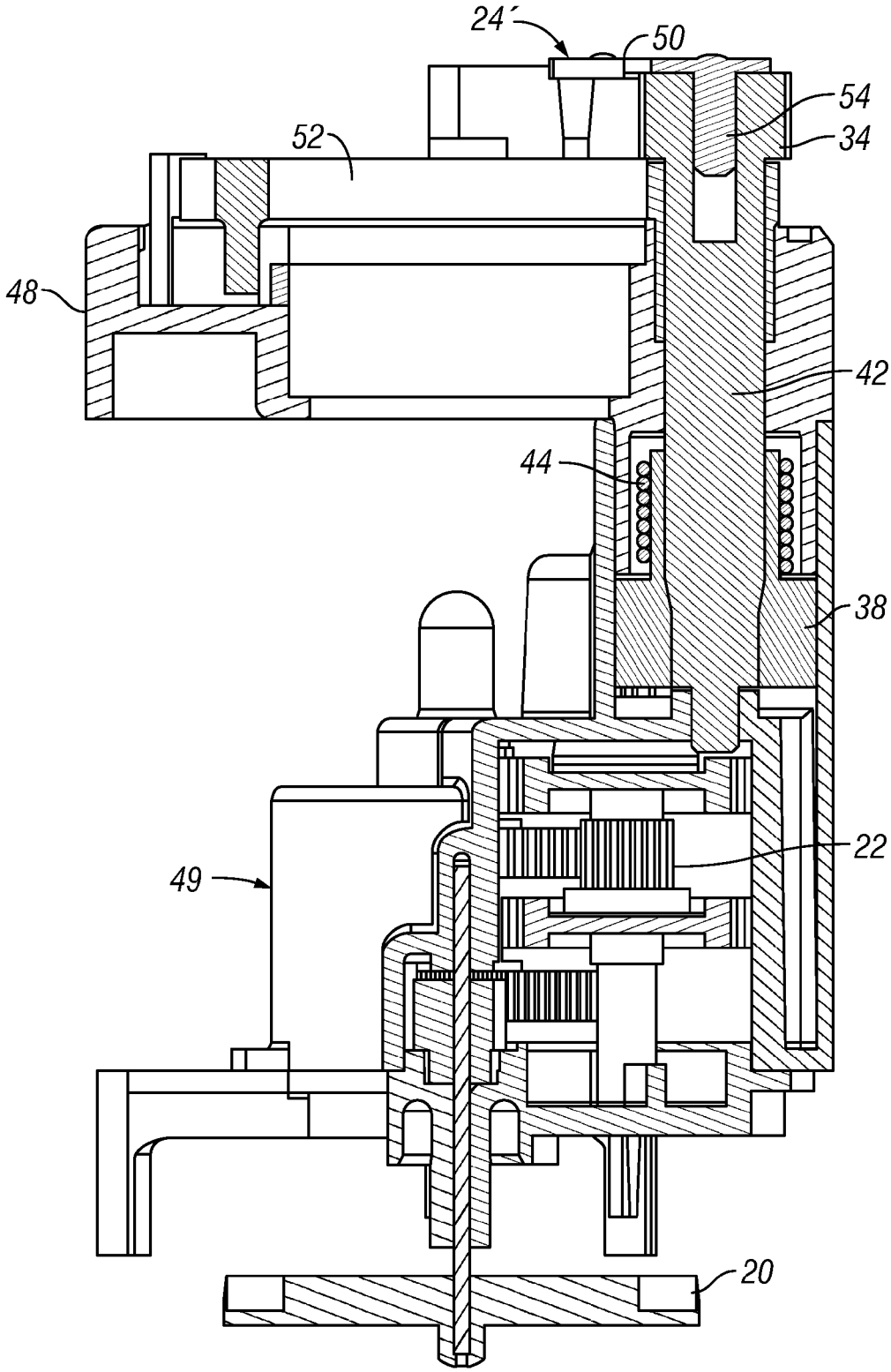
Figure 14:
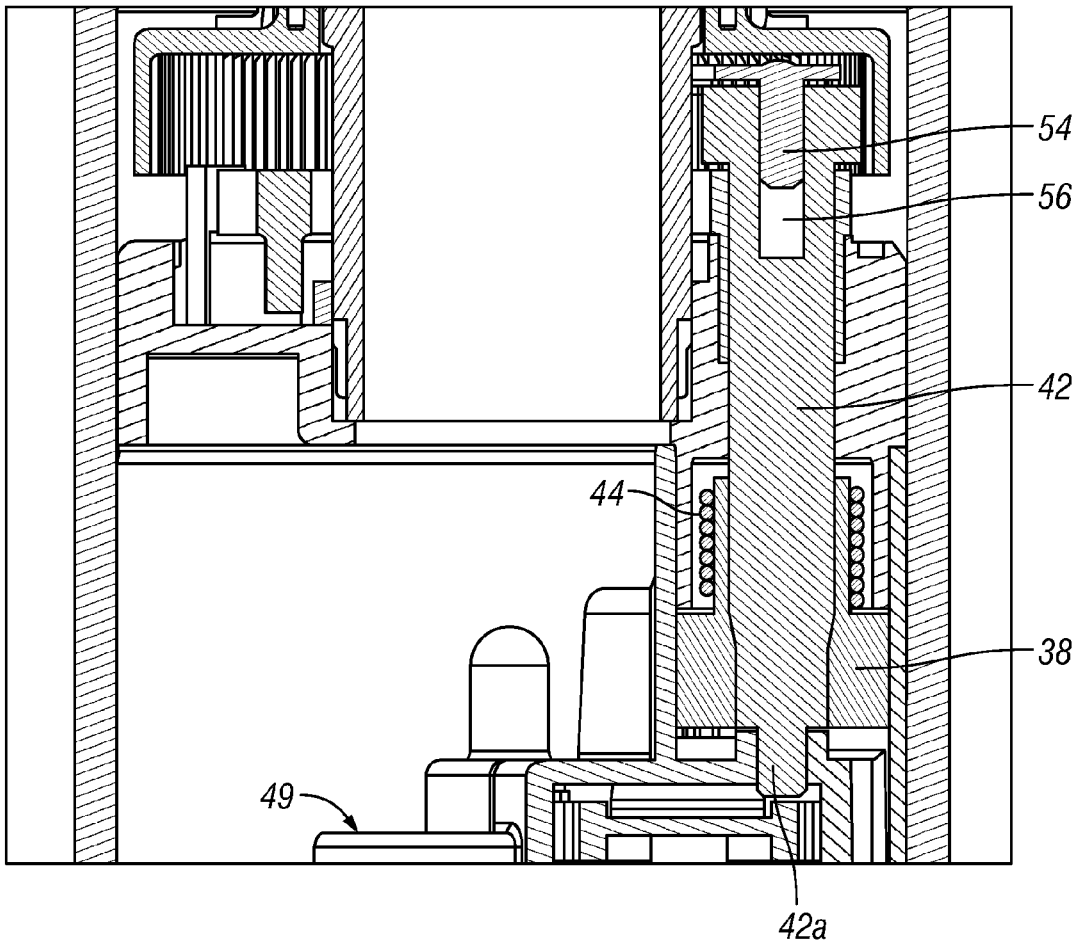

The friction clutch 30 includes a clutch member 36 (FIG. 2). The clutch member 36 and an output shaft 42 rotate about a common vertical axis. The lower portion of the clutch member 36 comprises a spur gear 38 (FIGS. 2-4) that directly engages the output gear 32 (FIG. 4) of the reduction gear train 22. The upper portion of the clutch member 36 comprises a split cylindrical sleeve 40 (FIG. 2) that surrounds and snugly engages an intermediate segment of the output shaft 42 (FIGS. 5 and 7) that also forms part of the friction clutch 30. The cylindrical sleeve 40 is split on diametrically opposite sides via vertical grooves 40*a* and 40*b* (FIG. 8A) that have curved lower ends. The grooves 40*a* and 40*b* allow the two halves of the split cylindrical sleeve 40 to be pushed against the output shaft 42. The clutch member 36 and the lower end of the output shaft 42 have a complementary tapered fit. A relatively small stainless steel coil spring 44 (FIGS. 2-6) surrounds the split cylindrical sleeve 40 and urges the smooth inner surface of the split cylindrical sleeve 40 against the smooth outer surface of the output shaft 42. The coil spring 44 and output shaft 42 extend within a cylindrical sleeve 46 (FIGS. 2 and 3) that fits over a complementary-shaped mounting cylinder 47 integrally formed with a horizontal partition 48 that supports the reversing mechanism 24. The sleeve 46 is integrally formed as part of a gear box 49 that encloses the reduction gear train 22. The upper end of the output shaft 42 is coupled to, and integrally formed with, the input gear 34 of the reversing mechanism 24 as best seen in FIG. 5. The input gear 34 is one of four identical spur gears of the reversing mechanism 24. These spur gears are carried on upper and lower frames 50 and 52 (FIG. 2) that rock back and forth on top of the partition 48 with the aid of stainless steel Omega over-center springs (not illustrated). A cylindrical locator 54 (FIG. 5) extends downwardly from the upper frame 50 into the upper end of a bore 56 in the output shaft 42 to secure the position of the output shaft 46 relative to the upper frame 50. The lower end 42*a* (FIG. 6) of the output shaft 42 has a reduced diameter and fits within a bearing 58 integrally molded into the gear box 49.

The friction clutch 30 holds under a normal level of rotational force generated internally by the turbine 20. The friction clutch 30 releases or slips under an excessive level of rotational force generated externally by a vandal twisting the nozzle turret 18. When this back driving occurs the static friction between the smooth inner surfaces of the split cylindrical sleeve 40 and the intermediate segment of the output shaft 42 is overcome and these parts spin relative to one another, and prevent damage to the reversing mechanism 24 and reduction gear train 22. When the excessive level of rotational force terminates, the friction between the split cylindrical sleeve 40 and the intermediate segment of the output shaft 42 re-establishes a positive driving connection between the reduction gear train 22 and the reversing mechanism 24. The stainless steel coil spring 44 (FIG. 3) maintains the correct load on the clutch member 36 over long periods of time and thereby provides accurate hold and slippage points.

The nozzle turret 18 can also become locked against rotation due to mechanical failure or debris and the friction clutch 30 will prevent damage to the reversing mechanism 24 and reduction gear train 22 under these conditions. The friction clutch 30 provides accurate control between the drive load and the breakaway load. It is relatively small and can be retrofitted into many existing rotor-type sprinklers. The friction clutch 30 is durable, reliable, and readily manufactured and assembled. The friction clutch 30 is located lower down in the drive assembly than conventional clutches in rotor-type sprinklers. Many conventional rotor-type sprinklers associate the clutch with the relatively large hollow tubular shaft 26. The location of the friction clutch 30 between the reduction gear train 22 and reversing mechanism 24 subjects the friction clutch 30 to lower forces, allowing it to be smaller than clutches associated with the tubular drive shaft 26. Breakaway force levels can be more easily predetermined utilizing the friction clutch 30 by selecting the correct coil spring 44, relative dimensions (length, diameter and degree of overlap) of the split cylindrical sleeve 40 and output shaft 42, the types of plastic from which the latter parts are molded, and/or the surface textures of its mating parts. The radial compressive force of the stainless steel coil spring 44 can be varied by changing the diameter of the wire from which the spring 44 is formed, the number and spacing of its coils, and/or its diameter.

FIGS. 9-14 are views corresponding to FIGS. 1-6 illustrating details of a rotor-type sprinkler 100 in accordance with an alternate embodiment of the invention. The sprinkler 100 is similar to the sprinkler 10 of FIGS. 1-8 except that in the sprinkler 100 the nozzle 28 can only rotate continuously, i.e. the sprinkler 100 cannot be adjusted so that nozzle 28 oscillates back and forth between arc limits. As indicated by the like reference numerals, many parts of the sprinkler 10 and the sprinkler 100 are the same. However, the "reversing mechanism" 24' of the sprinkler 100 lacks two of the spur gears otherwise mounted between the upper and lower frames 50 and 52, two Omega springs, as well as the resilient shift dog, and the top-side accessible arc adjustment mechanism of the sprinkler 100. The reversing mechanism 24' does not actually accomplish any reversing of the direction of rotation of the nozzle turret 18, rather, it is simply a subset of the parts of the reversing mechanism 24 of the sprinkler 10. When the turret 18 of the sprinkler 100 is rotated by a vandal in the same direction as the direction of rotation of the nozzle 28 the load is taken off the drive assembly and therefore the friction clutch 30 does not slip. However, when the turret 18 is rotated by a vandal in the reverse direction the friction clutch 30 slips under the excessive load to prevent damage to the reversing mechanism 24' and reduction gear train 22.

While we have described several embodiments of our invention, modifications and adaptations thereof will occur to those skilled in the art. Therefore, the protection afforded our invention should only be limited in accordance with the scope of the following claims.

We claim:

1. A sprinkler, comprising:

a riser;

an impeller mounted in the riser;

a nozzle rotatably mounted at an upper end of the riser;

a drive assembly including a reduction gear train coupling the impeller and the nozzle; and a friction clutch in the drive assembly coupled to an output gear of the reduction gear train that provides a positive drive connection under a normal load and slips under an excessive load, the friction clutch including a clutch member surrounding an output shaft that rotates about an axis of rotation of the friction clutch and a spring that urges the clutch member against the output shaft.

2. The sprinkler of claim 1 and wherein the spring is a coil spring.

3. The sprinkler of claim 1 wherein the drive assembly further includes a reversing mechanism and the friction clutch is located between an output gear of the reduction gear train and an input gear of the reversing mechanism.

4. The sprinkler of claim 3 wherein the output shaft has an end coupled to the reversing mechanism.

5. The sprinkler of claim 1 wherein the clutch member has a first cylindrical portion that is surrounded by the spring and a second portion in the form of a spur gear that engages the output gear of the reduction gear train.

6. The sprinkler of claim 1 wherein the coil spring and output shaft extend within a sleeve connected to a partition that supports the reversing mechanism.

7. The sprinkler of claim 4 wherein the end of the output shaft is coupled to the input gear of the reversing mechanism.

8. The sprinkler of claim 1 wherein the mating surfaces of the clutch member and the output shaft are smooth.

9. The sprinkler of claim 1 wherein the clutch member and the lower end of the output shaft have a complementary tapered fit.

10. A sprinkler, comprising:

a riser;

an impeller mounted in the riser;

a nozzle rotatably mounted at an upper end of the riser;

a drive assembly including a reduction gear train and a reversing mechanism coupling the impeller and the nozzle; and a friction clutch in the drive assembly located between an output gear of the reduction gear train and an input gear of the reversing mechanism that provides a positive drive connection under a normal load and slips under an excessive load, the friction clutch including an output shaft, a clutch member that surrounds the output shaft and having a split upper cylindrical portion and a lower portion in the form of a spur gear that engages the output gear of the reduction gear train, and a coil spring that surrounds the split upper cylindrical portion for urging the split upper cylindrical portion of the clutch member against the output shaft.

* * * * *